United States Patent [19]

Martyak

[11] Patent Number: 4,810,336

[45] Date of Patent: Mar. 7, 1989

[54] ELECTROPLATING BATH AND PROCESS FOR DEPOSITING FUNCTIONAL, AT HIGH EFFICIENCIES, CHROMIUM WHICH IS BRIGHT AND SMOOTH

[75] Inventor: Nicholas M. Martyak, Hazlet, N.J.

[73] Assignee: M&T Chemicals Inc., Woodbridge, N.J.

[21] Appl. No.: 209,679

[22] Filed: Jun. 21, 1988

[51] Int. Cl.[4] ..... C25D 3/10

[52] U.S. Cl. ..... 204/51

[58] Field of Search ..... 204/51, 43.1

[56] References Cited

U.S. PATENT DOCUMENTS

| | | | |
|---|---|---|---|
| 3,758,390 | 9/1973 | Chessin et al. | 204/51 |
| 3,804,728 | 4/1974 | Chessin et al. | 204/51 |
| 4,472,249 | 9/1984 | Chessin | 204/51 |

*Primary Examiner*—G. L. Kaplan

*Attorney, Agent, or Firm*—S. A. Marcus; W. Katz

[57] ABSTRACT

A functional chromium electroplating bath and process is disclosed. The bath comprises chromic acid, sulfoacetic acid, iodate and a nitrogen organic compound. Such a bath gives chromium deposits which are both bright and adherent.

14 Claims, No Drawings

ELECTROPLATING BATH AND PROCESS FOR DEPOSITING FUNCTIONAL, AT HIGH EFFICIENCIES, CHROMIUM WHICH IS BRIGHT AND SMOOTH

BACKGROUND OF INVENTION

1. Field of the Invention

This invention relates to electrodeposited layers, and, more particularly, to functional, electrodeposited chromium layers having advantageous performance properties, and to a chromium plating bath and method for forming such useful chromium electrodeposits.

2. Description of the Prior Art

Hexavalent chromium plating baths are described in U.S. Pat. Nos. 2,750,337; 3,310,480; 3,311,548; 3,745,097; 3,654,101; 4,234,396; 4,406,756; 4,450,050; 4,472,249; and 4,588,481. These baths generally are intended for "decorative" chromium plating or for "functional" (hard) chromium electrodeposition. Decorative chromium plating baths are concerned with deposition over a wide plating range so that articles of irregular shape can be completely covered. Functional chromium plating, on the other hand, is designed for regularly shaped articles, where plating at a high current efficiency and at high current densities is of particular importance.

Functional hexavalent chromium plating baths containing chromic acid and sulfate as a catalyst generally permit the deposition of chromium onto a basis metal substrate at cathode efficiencies of about 12% to 16% at current densities of about 1 to 6 asi. Mixed catalyst chromic acid plating baths containing both sulfate and fluoride ions generally allow for chromium plating at higher cathode efficiencies, e.g. at 22% to 26%, and at higher rates. However, the presence of fluoride ion in such baths causes etching of ferrous based metal substrates.

Other chromium plating baths which use iodide, bromide or chloride ions as additives can operate at even high current efficiencies, but these baths produce chromium deposits which do not adhere well to the substrate, and which are dull in appearance, or at best only semi-bright. For example, Chessin, in U.S. Pat. No. 4,472,249, describes a high energy efficient functional chromium electroplating bath which operates at very high current efficiencies, e.g. about 50%. This bath generally consist of chromic acid, sulfate, iodide, and a carboxylate; it is used at conventional current densities, e.g. between about 1 to 6 asi. Unfortunately, this bath has adherence problems, and provides only a semi-bright deposit.

Chessin and Newby, in U.S. Pat. No. 4,588,481, describes a method for producing non-iridescent, adherent, bright chromium deposits at high efficiencies without low current density etching. This method involves plating at a temperature of 45°-70° C. from a functional chromium plating bath consisting essentially of chromic acid and sulfate, and a non-substituted alkyl sulfonic acid having a ratio of S/C of $>\frac{1}{3}$, in the absence of a carboxylic or dicarboxylic acid.

Accordingly, an object herein is to provide chromium electrodeposits which are adherent, bright, smooth, hard, and which can be formed at high efficiencies and operate within useful current densities.

These and other objects will be made apparent from the following more detailed description of the invention.

SUMMARY OF INVENTION

In accordance with the above objects of the invention, there is provided herein an improved chromium plating bath for deposition of bright, smooth, functional chromium at conventional plating current densities.

The chromium plating bath of the invention consists essentially of chromic acid, sulfoacetic acid, in a concentration range of about 40 g/l to 150 g/l, an iodine-releasing agent, and a nitrogen organic compound as a depolarizer.

The chromium electrodeposits of the invention are particularly characterized as being smooth and bright within an operating current density range of about 1-10 asi.

The plating bath herein is further characterized as being substantially free of deleterious carboxylic acids, fluoride ion, bromide ion, and selenium ion.

DETAILED DESCRIPTION OF THE INVENTION

A typical functional chromium electroplating bath in accordance with the invention has the following constituents present.

TABLE I

| | Suitable (g/l) | Preferred (g/l) |
|---|---|---|
| Constituent | | |
| Chromic acid | 150–450 | 200–350 |
| Sulfoacetic acid* | 40–150 | 80–120 |
| Iodate | 0.5–10 | 1–3 |
| Nitrogen Organic Compound | 1–40 | 3–15 |
| Optional Constituent | | |
| Sulfate | 0–4.5 | 2–3 |
| Operating Conditions | | |
| Current density (asi) | 1–10 | 1–4 |
| Temperature (°C.) | 45–70 | 50–60 |

*Sulfoacetic acid can be present also as sulfoacetate, or isethionic acid or an isethionate, which oxidize in the plating bath to provide sulfoacetic acid in the desired concentration.

The current efficiencies obtained using the plating bath composition of the invention are in the range of about 21%.

A typical chromium electrodeposit formed on a basis metal, e.g. steel, from the electroplating bath of the invention, under the conditions described above, has the following physical properties, chemical composition and performance characteristics.

TABLE II

| |
|---|
| Physical Properties |
| Adhesion to substrate - excellent |
| Brightness - excellent |
| Surface - smooth |
| Performance Characteristics |
| Hardness - $KN_{100} > 1100$, e.g. 1100–1400* |
| Coefficient of friction - excellent |
| Wear resistance - excellent |

*$KN_{100}$ is Knoop Hardness employing a 100 g weight. All values are expressed in Knoop Hardness Units (KH).

Typical nitrogen organic compounds for use in the chromium electroplating bath of the invention include:

glycine
nicotinic acid
isonicotinic acid pyridine
2-aminopyridine
3-chloropyridine
picolinic acid
guanine
guanidine acetic acid
adenine The nitrogen organic compound in the chromium electroplating bath of the invention functions as a depolarizer in the electroplating process.

The invention will be described in more detail hereinafter with reference to the following example.

EXAMPLE 1

A chromium electroplating bath was prepared having the following composition.

| | |
|---|---|
| Chromic Acid | 250 g/l |
| Sulfoacetic acid | 100 g/l |
| Iodate* | 1 g/l |
| Sulfate** | 2.5 g/l |
| Nicotinic acid | 10 g/l |

*added as potassium iodate
**added as sodium sulfate

Chromium was plated from this bath onto a nickel-plated steel mandrel at 3 asi, at 55° C. for 10 min., to produce a bright, smooth, adherent chromium layer thereon having a thickness of 0.5 mils. The current efficiency was 20%. The chromium electrodeposit had the physical and performance properties given in Table II above. The hardness value $KN_{100}$ was 350.

EXAMPLE 2

A chromium electroplating bath was prepared having the following composition.

| | |
|---|---|
| Chromic Acid | 250 g/l |
| Sulfoacetic acid | 80 g/l |
| Iodate | 3 g/l |
| Sulfate | 2 g/l |
| Glycine | 5 g/l |

Chromium was plated from this bath onto a stainless steel mandrel at 2 asi, at 60° C. for 30 min. to produce a chromium layer thereon having a thickness of 1.0 mils. The current efficiency was 22%.

The chromium electrodeposit had the physical and performance properties given in Table II above. The hardness value $KN_{100}$ was 1300.

EXAMPLE 3

The chromium plating bath had the following composition:

| | |
|---|---|
| Chromic acid | 225 g/l |

-continued

| | |
|---|---|
| Sulfoacetic acid | 60 g/l |
| Iodate | 2 g/l |
| Sulfate | 2.0 g/l |
| Picolinic acid | 10 g/l |

Chromium was plated onto a steel mandrel at 5 asi at 60° C. for 60 minutes to produce a chromium layer having a thickness of 2.0 mils. The current efficiency was 20%. The physical properties and chemical composition of the chromium electrodeposit were similar to those given in Table II above. The hardness values $KN_{100}$ was 1325.

What is claimed is:

1. A functional chromium plating bath consisting essentially of chromic acid, 40–150 g/l of sulfoacetic acid, iodate, and a nitrogen organic compound.

2. A functional chromium plating bath according to claim 1 wherein said bath is substantially free of other carboxylic acids, fluoride ion, bromide ion, and selenium ion.

3. A functional chromium plating bath according to claim 1 wherein chromic acid is present in an amount of about 150 g/l to 450 g/l.

4. A functional chromium plating bath according to claim 1 wherein sulfoacetic acid is present in an amount of about 80–120 g/l.

5. A functional chromium plating bath according to claim 1 wherein said bath also includes sulfate in an amount up to about 4.5 g/l.

6. A functional chromium plating bath according to claim 1 wherein said nitrogen organic compound is present in an amount of about 1–40 g/l.

7. A functional chromium electroplating bath according to claim 1 wherein said nitrogen organic compound is selected from glycine, nicotinic acid, isonicotinic acid, pyridine, 2-aminopyridine, 3-chloropyridine, picolinic acid, guanine, guanidine acetic acid, and adenine.

8. A functional chromium electroplating bath according to claim 1 wherein said nitrogen organic compound is glycine.

9. A process for electroplating functional chromium layer onto a basis metal which comprises electrodepositing from the electroplating bath of claim 1.

10. A process according to claim 9 wherein said electrodepositing is carried out at a temperature of about 50°–70° C.

11. A process according to claim 9 wherein the thickness of said electrodeposited chromium layer is about 0.1–2 mils.

12. A process according to claim 9 wherein electrodeposition is carried out at a plating current density of about 1–10 asi.

13. A process according to claim 12 wherein the thickness of said electrodeposited chromium layer is at least 0.1 mil thick.

14. A process according to claim 9 wherein the current efficiency is at least about 20%.

* * * * *